United States Patent [19]

Friel

[11] Patent Number: 4,807,399

[45] Date of Patent: Feb. 28, 1989

[54] METHOD AND APPARATUS FOR SHARPENING A KNIFE

[75] Inventor: Daniel D. Friel, Greenville, Del.

[73] Assignee: Edgecraft Corp., Wilmington, Del.

[21] Appl. No.: 917,601

[22] Filed: Oct. 9, 1986

Related U.S. Application Data

[63] Continuation-in-part of Ser. No. 588,794, Mar. 12, 1984, Pat. No. 4,627,194, and a continuation-in-part of Ser. No. 855,147, Apr. 23, 1986, Pat. No. 4,716,689, which is a continuation-in-part of Ser. No. 588,795, Mar. 12, 1984, abandoned.

[51] Int. Cl.[4] ..... B24B 9/00; B24B 1/00

[52] U.S. Cl. ..... 51/109 BS; 51/116; 51/119; 51/128; 51/285; 51/326

[58] Field of Search ..... 51/3 R, 116, 119, 128, 51/205 WG, 285, 210, 326, 109 BS

[56] References Cited

U.S. PATENT DOCUMENTS

| | | | |
|---|---|---|---|
| 1,068,973 | 7/1913 | Brown | 51/128 |
| 2,787,100 | 4/1957 | Peyches | 51/119 X |
| 3,071,899 | 1/1963 | Hicks et al. | 51/128 |
| 3,332,173 | 7/1967 | McMaster et al. | 51/128 |

*Primary Examiner*—Debra Meislin

*Attorney, Agent, or Firm*—Connolly & Hutz

[57] ABSTRACT

A knife sharpener is provided with a pre-sharpening section and with two honing sections. The pre-sharpening section includes a pair of spring biased back to back rotary disks. The honing sections include orbitally driven sharpening members.

13 Claims, 3 Drawing Sheets

Fig. 6.
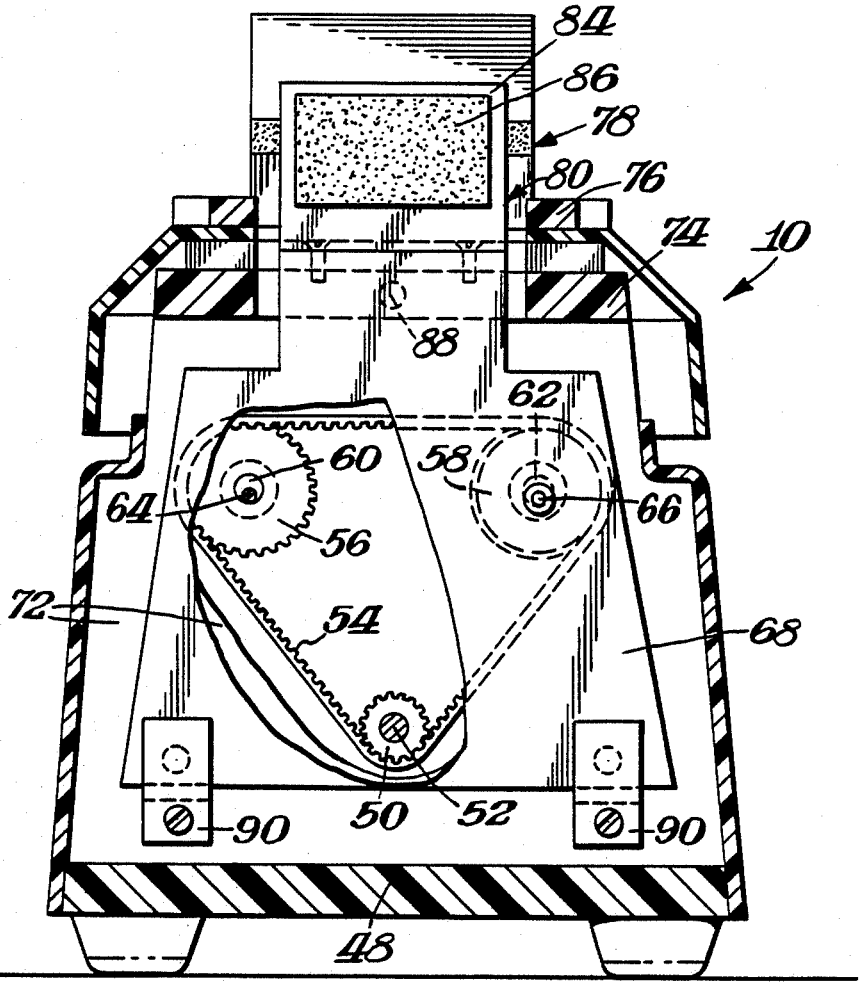
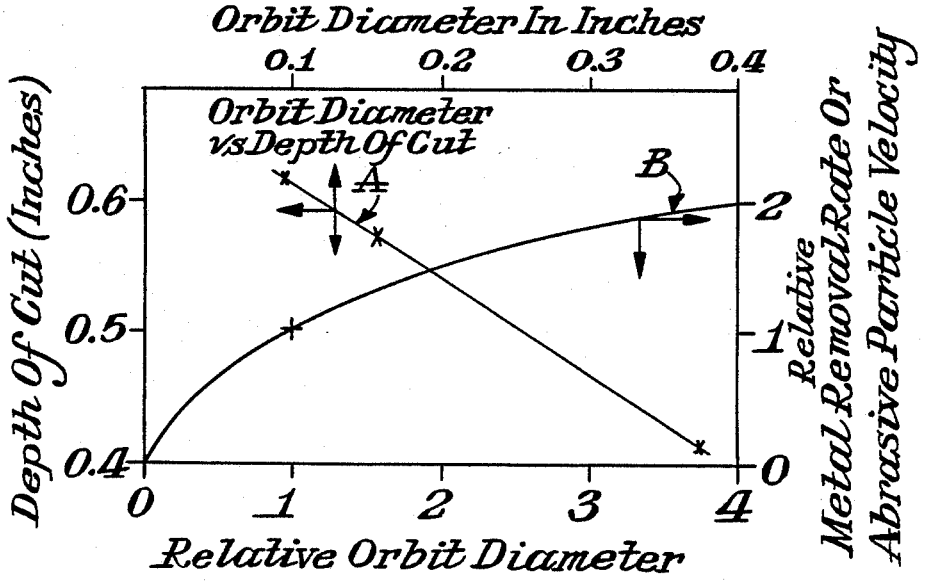
Fig. 7.

METHOD AND APPARATUS FOR SHARPENING A KNIFE

CROSS-REFERENCE TO RELATED APPLICATIONS

This application is a continuation-in-part of application Ser. No. 588,794, filed Mar. 12, 1984, now U.S. Pat. No. 4,627,194 and Ser. No. 855,147 filed Apr. 23, 1986 now U.S. Pat. No. 4,716,689 which in turn is also a continuation-in-part of Ser. No. 588,795 filed Mar. 12, 1984, now abandoned.

BACKGROUND OF INVENTION

This application relates to a knife sharpener and a method of sharpening knives. The above noted parent applications describe in detail such a knife sharpener which has been found to be particularly effective. The present application is directed to certain aspects of that sharpener and its method of use.

SUMMARY OF INVENTION

An object of this invention is to provide a knife sharpener having an effective pre-sharpening section.

A further object of this invention is to provide a knife sharpener having a particularly effective honing section or sections.

A still further object of this invention is to provide a method of sharpening a knife.

In accordance with this invention the pre-sharpener section includes a pair of resiliently biased back to back rotary disks having abrasive particles on their remote faces. Preferably, flat diamonds are used as the abrasive particles.

At least one sharpening section is provided wherein the abrasive carrying sharpening member is orbitally driven. Preferably the orbital motion of each abrasive particle is no greater than ⅜" effective diameter, and its orbital velocity is from 15 to 1500 feet/minute.

THE DRAWINGS

FIG. 1 in a side elevation view of a knife sharpener in accordance with this invention;

FIG. 6 is a cross-sectional view taken through FIG. 5 along the line 6—6; and

FIG. 7 is a chart comparing the metal removal rate and knife edge cutting effectiveness as a function of orbital diameter.

DETAILED DESCRIPTION

The present invention utilizes the teachings of the above-noted parent applications, the details of which are incorporated herein by reference thereto. To avoid repetition the present description will be concerned with certain aspects of the pre-sharpening section and with the orbital drive for the honing sections, as well as the specific abrasive surface. Other features such as the magnetic guides will be referred to only in general terms.

Figure 1:
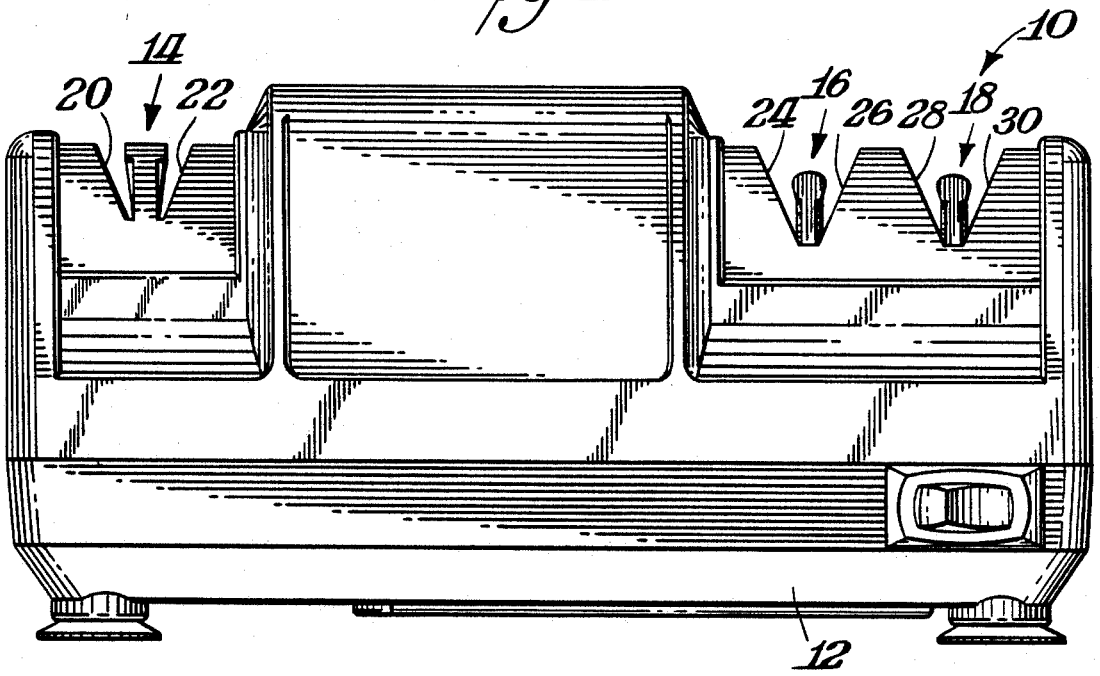

FIG. 1 shows a knife sharpener 10 in accordance with this invention. Sharpener 10 includes a housing 12 in which are provided a pre-sharpening section 14, a first honing section 16 and a final honing section 18. Each of these sections includes a pair of slots with an exposed abrasive surface being provided at each slot. Additionally guide means, preferably the magnetic guides described in the parent applications, disposes the knife edge or cutting facet at a predetermined angle with the angles of each section differing. The guides of the two sets of guide means in each section are disposed at mirror image angles to each to progressively increase the angle of the cutting facet from, for example, 40° in the pre-sharpening section 14, to 45° in honing section 16 and finally to 50° in honing section 18.

In operation the user would first place the knife in a slot 20 in pre-sharpening section 14. After passing the knife through either slot 20 or slot 22 a suitable number of times, the procedure would be repeated in the other slot. This results in removing the old edge of the knife and creating the first edge angle. The knife edge would then be honed at a second angle by passing through slots 24, 26 in honing section 16. Finally, the knife edge would be honed or polished to its final angle by passing through slots 28, 30 in honing section 18.

Figure 2:
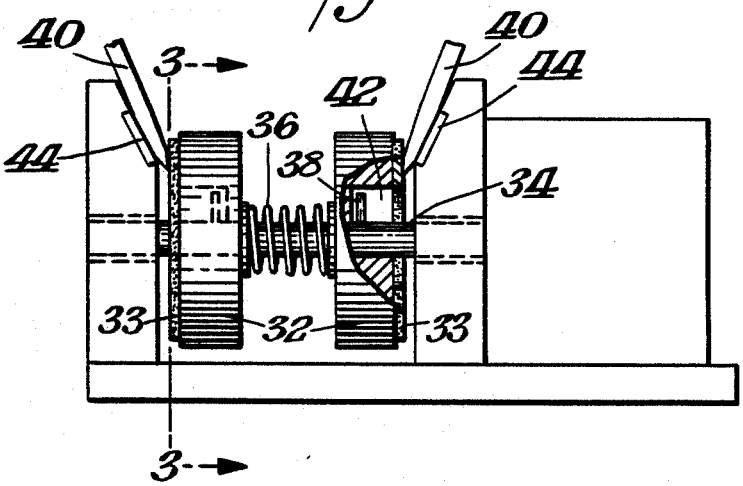
FIG. 2 is a side elevation view partly in section of the pre-sharpening section of the knife sharpener shown in FIG. 1.
Figure 3:
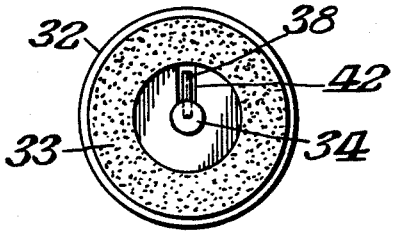
FIG. 3 is a cross-sectional view taken through FIG. 2 along the line 3—3.

FIGS. 2–3 show a preferred form of the pre-sharpening section using a dual disk arrangement. The double disk design has proven particularly effective to permit the operator to sharpen conveniently both cutting edge facets of a knife from the same side of the sharpener. In this arrangement two disks 32, 32 are secured and positioned back to back on a driven shaft 34 and held apart against stops in their rest positions by a biasing mechanism, such as resilient spring 36, located between the two disks forcing the disks apart. Travel of each disk along the shaft axis is limited in one direction by the stop or pin 38 located on the shaft and in the other direction by the position of the second disk or the biasing mechanism. The permissible travel of each disk against the biasing mechanism and toward the opposite disk must be sufficient to avoid the possibility of the disk reaching its limit of travel against the biasing mechanism at any time while the knife 40 being sharpened pressing against the front face of the disk is displacing the disk against the biasing mechanism. The disks secured to the stops can slide independently on their common shaft while each is forced to rotate at the shaft speed by the pin 38 fastened to or through the shaft, that engages within a slotted portion 42 of the hub of each disk. The pin 38 also can serve as a stop to control position of the disks in this rest position. Other means of driving the disks at shaft speed while allowing the disks to slide on the shaft will be obvious to those skilled in mechanical arts. Abrasive 33 mounted on the outside or front faces of each disk 32, 32 rotating on the shaft 34 is pressed against the knife cuttingedge facet during sharpening by a force determined by the spring or other biasing means. For a given knife and type abrasive, the rate of metal removal during sharpening depends on the biasing force and on the size and speed and number of the abrasive particles. As shown guides 44 are adjacent disks 32, 32.

One of the notable features of this invention is the provision of a substantially flat abrasive surface in each of the sections 14, 16, 18. This is accomplished by utilizing diamond abrasive particles having flat surfaces which stay flat. Diamond covered surfaces are unique in that they are very abrasive but the diamond does not wear significantly. This makes it possible to maintain extraordinarily precise control of angles in each stage even after the sharpener has been used extensively. Success of the three stage system results from the precise angles in each stage and maintaining their relationship—one to the other—over long usage. This is done by the use of diamonds, flat surfaces, and very little "play" of the surfaces in their guide mechanism or guide system. The combination with the spring-loaded disk results in the positioning of the knife edge across a substantial chord of the disk. The spring avoids jamming of the blade between the guide and flat diamond disk. The large chord insures multi-directional attack by the diamonds to do the sharpening. The prior art generally avoids multi-directional attack by using cone-shaped abrasive surfaces or working near the edge of the disk.

In practice the diamond members are electroplated on the flat support surface.

Figure 4:
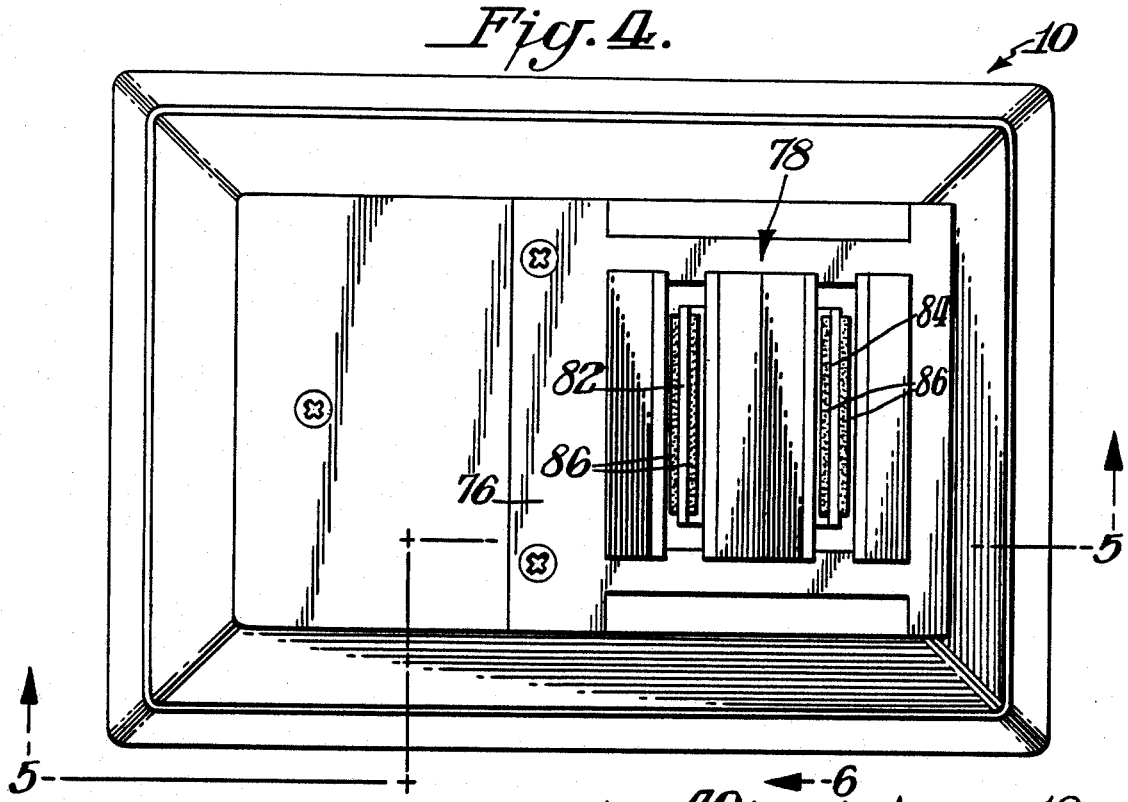
FIG. 4 is a top plan view of a honing section of a knife sharpener in accordance with this invention.
Figure 5:
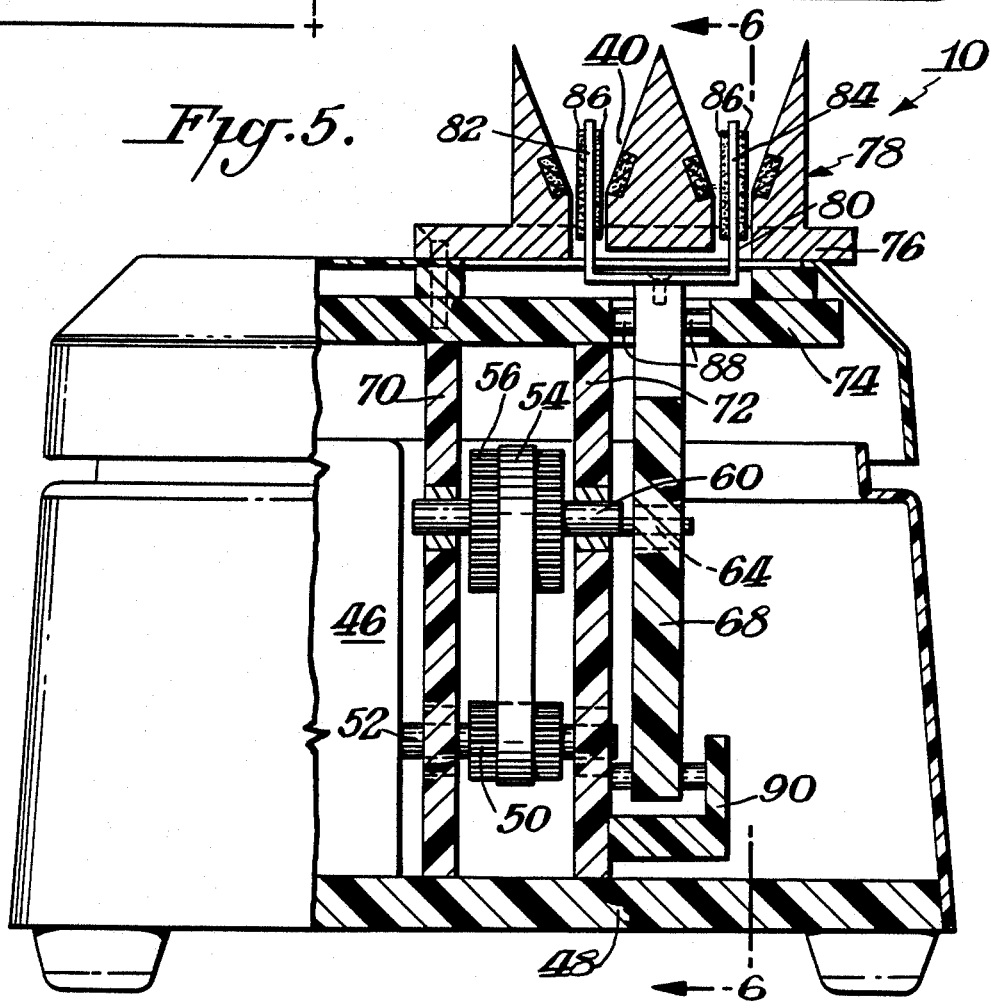
FIG. 5 is a cross-sectional view taken through FIG. 4 along the line 5—5.

FIGS. 4–6 show a honing section which may be used alone or incorporated in sharpener 10, in which the orbiting abrasive surfaces move in a vertical plane. In this embodiment, a motor 46 of FIG. 5 is mounted on base plate 48 and drives a gear pulley 50 mounted on motor shaft 52. Timing belt 54 driven by gear pulley 50 drives gear pulleys 56 and 58 mounted on horizontal drive shafts 60 and 62 whose ends are machined to form drive cranks 64 and 66. The drive cranks 64 and 66 driven synchronously by this belt-gear pulley arrangement engage into crank bearings mounted in an orbiting drive plate 68 so that orbiting drive plate 68 is driven in an orbital path. Vertical support plates 70 and 72, FIG. 5, mounted on the base plate 48 provide support and alignment for motor shafts 52 and drive shafts 60 and 62, and support for upper plate 74 and guide support plate 76, that in turn supports a knife-guide assembly 78, of the type described in the parent applications. Bearings mounted in vertical support plate 72 provide support for one end of drive shafts 60 and 62. Similar bearings are mounted in vertical plate 70 for the other end of drive shafts 60 and 62. A motor shaft bearing provides support for the end of motor shaft 52. It is mounted in vertical support plate 72. Orbiting drive plate 68 supports a yoke 80 made of metal or plastic whose upper arms 82 and 84 serve as mounting supports for diamond abrasive materials 86 that orbits within the stationary knife guide assembly 78.

Orbiting drive plate 68 is held in position by at least three pairs of support bearings 88, with pair members positioned on either side of orbiting drive plate 68 in slidingly contact with orbiting drive plate 68 and held in place by upper plate 74 and by lower bracket 90 fastened to vertical support plate 72 by adhesive or suitable screws, not shown. This maintains at all times a three point supporting means for orbiting drive plate 68. In an acceptable alternative arrangement, not shown, the support bearings 88 could be affixed to the orbiting drive plate 68 and rest in slidingly contact with upper plate 74 and lower bracket 90.

Means are provided through a contact adhesive or other arrangement for removal and replacement of individual abrasive material 86 and/or for replacement of all abrasive materials 86 simultaneously with their supporting yoke 76 by means of screws or other devices. At any time during sharpening, there is a small clearance on the order of 0.001 inch between certain of the support bearings 88 and the orbiting drive plate 68 but in use there is also actual contact between the orbiting drive plate 68 and three of the support bearings 88 depending on the direction of force of the knife against the abrasive material 86. At any time the orbiting drive plate is forced to cycle in one of several closely spaced planes established by the support bearings and the spacing between these bearings in slidingly contact with the plate. In this manner very positive support is provided at all times that stabilizes the plane of the orbiting drive plate 68 and the attached abrasive material 86. With this unique contact support means, there is no need for restraining springs or the like that would otherwise introduce greater frictional force on the face of support bearings 88 and increase the power requirements for the drive means.

Where there is some twisting force on the orbiting drive plate 68, FIG. 5, caused by the sharpening action, more than the six support bearings 88 may be desirable. However when sharpening normally not more than three are being used at any instant in time. The crank bearings, motor shaft bearing and shaft bearings support the end of motor shaft 52, eccentric cranks 64 and 66, and the drive shafts 60 and 62. These bearings can be eliminated if vertical support plates 70 and 72 and the orbiting drive plate 68 are made of a material such as a high temperature glass-filled polyester or other material that can serve both as a rugged structural material and as a bearing material. Any knife guide assembly 78 used with this sharpener should be supported through the guide support plate 76 onto upper plate 74, FIG. 5 and FIG. 6, or other rigidly attached member such as vertical support plate 72 that also provides direct or indirect support for the support bearings 88 that establish the position of the orbiting drive plate 68. In this manner any major vibrations of the mechanical supporting structure incorporating members 72, 70, and 74 affect alike the knife guide assembly 78 and the orbiting components including 68, 80, 82, 84 and abrasives 86. By this means the relative motion between the knife guide assembly 78 and the orbiting abrasive material 86 is minimized as caused by vibrations and movements of those major structural parts held together by structural adhesive or screws.

Applicant has discovered that there is an optimum range of the effective orbit-diameter determined by metal removal rates and quality of the final knife edge. It was surprising to discover, as shown in curve A of FIG. 7, that as the orbital diameter is reduced the quality of the edge, i.e. the cutting ability of the resulting knife edge, improves. However, as the diameter of the orbit or the velocity of the diamond particles is reduced the metal removal rate and sharpening rate is reduced. Obviouslv at zero diameter orbit the velocity of diamond particles relative to the knife is zero and no sharpening occurs. These effects are shown graphically in FIG. 7, as later described.

It has been found that a high enough velocity can be achieved for a practical metal removal rate using diamonds as the abrasive at linear speeds as low as 15 or 20 feet/minute (orbiting). At velocities above 1500 feet/minute there is danger of overheating the fine knife edge being formed—thereby losing its hardness (temper).

At a diamond velocity of 1500 feet/minute (orbiting) the design of an unsecured (i.e. not fastened down) sharpener is difficult for mechanical reasons. The apparatus at this speed should be clamped down or it may "walk" around the table.

Considering the mechanical stability of the sharpener it was found possible to maintain a constant level of stability with a larger orbit, if at the larger orbit the RPM is reduced approximately by the square root of the increase in orbit size, as shown in curve B of FIG. 7. This means if the diameter is increased by a factor of 4, the RPM must be reduced by about ½. This also means if the orbital diameter goes up by 4, for example, the diamond particles velocity may increase only about 2 fold—to maintain the same stability as reflected in curve B of FIG. 7.

For reasons of edge quality (knife cutting ability) and reasonable sharpening rates, but limited by overheating of the edge at velocities above 1500 feet/minute and by mechanical instabilities of the sharpener, it has been found surprisingly that the acceptable operating ranges for superior edge quality is well defined and relatively narrow with an effective orbital diameter in the range 0" to ⅜" and with practical diamond particle velocities in the range of about 15 to 1500 feet/minute. The orbit can be somewhat elliptical without a detrimental effect on the perfection of the edge being formed so long as the effective diameter, defined as particle path length divided by $\pi$, remains in the range previously noted.

The cutting ability of knife edges produced with final orbit sizes of 0.094", 0.156", and 0.375" (600 grit) was determined experimentally by measuring the depth of cut made by one stroke of the weighted knife into the edge of a cardboard sheet as follows:

| Orbit Diameter Used (inches) | Average Depth of Cut in Cardboard (inches) |
|---|---|
| 0.094" | 0.617" |
| 0.156" | 0.570" |
| 0.375" | 0.415" |

The results of these tests are shown in FIG. 7 where line A plots orbit diameter versus depth of cut. Line B represents the relative metal removal rate as related to the relative orbit diameter, at constant mechanical stability of the sharpener. The knife edges were produced at an orbiting speed of 1,500 rpm using an abrasive grit size of 600 with the knife blade edge formed at a total angle of about 50°.

As can be appreciated, the present invention thus not only provides for orbital drive in honing sections 16 and 18, but also teaches an optimal size range and velocity of orbital motion.

What is claimed:

1. A knife sharpening apparatus for sharpening a knife having a cutting edge facet comprising a rotatably mounted drive shaft, drive means for rotating said shaft, a first disk assembly slidably mounted on said shaft, said first disk assembly having a back face and a front face perpendicular to said shaft, a second disk assembly slidably mounted on said shaft, said second disk assembly having a back face an a front face perpendicular to said shaft, said back faces of said disk assemblies being disposed toward each other and said front faces being disposed remote from each other, resilient means between said back aces and reacting against said assemblies for urging said front faces away from each other, stop means on said shaft or limiting the sliding motion of said disk assemblies imparted by said resilient means, a slot in each of said assemblies terminating short of said back faces leaving a wall portion, said stop means comprising a pin mounted to said shaft and located in each of said slots whereby said pins function to halt the motion of said disk assemblies when contacted by said wall portions and to prevent relative rotation of said disk assemblies with respect to said shaft for causing said disk assemblies to rotate with said shaft, and abrasive means on said front faces.

2. The apparatus of claim 1 wherein each of said front faces is flat, and aid abrasive means comprising diamond particles with generally flat surfaces.

3. The apparatus of claim 2 including guide means outwardly beyond an adjacent each of said front faces for positioning the cutting edge facet at a predetermine angle against a substantial chord of said front face, and said resilient means urging each of said disk assemblies toward its respective guide means.

4. The apparatus of claim 3 including a housing having a pre-sharpening section and a honing section, said disk assemblies and said guide means being in said pre-sharpening section, a sharpening member in said honing section, said sharpening member having a flat outer face with abrasive particles mounted thereon, drive means for orbitally driving said sharpening member, and said drive means imparting an orbital motion to each of said particles of no greater than ⅜ inch effective diameter and an orbital velocity of no greater than 1500 feet/minute.

5. The apparatus of claim 4 wherein said abrasive particles are diamond particles with generally flat surfaces.

6. The apparatus of claim 5 wherein said guide means are at mirror image angles, said sharpening member of said honing section having a flat outer face on each face thereof with said abrasive particles on each of said outer faces, honing section guide means for each of said outer faces, and said honing section guide means being at mirror image angles different than said mirror image angles of said pre-sharpening section.

7. The apparatus of claim 6 including a second honing section, a sharpening member in said second honing section, said second honing section sharpening member having a pair of flat outer faces with abrasive particles mounted thereon, drive means for orbitally driving said second honing section sharpening member, and guide means for each of said second honing section sharpening member outer faces at mirror image angles different than said mirror image angles of said pre-sharpening and honing sections.

8. The apparatus of claim 1 including a housing having a pre-sharpening section and a honing section, said disk assemblies being in said pre-sharpening section, a sharpening member in said honing section, said sharpening member having a flat outer face with abrasive particles mounted thereon, drive means for orbitally driving said sharpening member, and said drive means imparting an orbital motion to each of said particles of no greater than ⅜ inch effective diameter and an orbital velocity of no greater than 1500 feet/minute.

9. A knife sharpening apparatus comprising a housing, a pre-sharpening section and first and second honing sections in said housing, a rotatable shaft in said pre-sharpening section, a pair of back to back disks mounted on said rotatable shaft, abrasive particles on each of said disks, a slot in said housing for each of said disks, guide means in said housing opposite each of said slots and their respective disks, said guide means having guide surfaces at mirror image angles to each other, each of said honing sections having a sharpening member with a pair of flat outer faces having abrasive particles thereon, drive means for orbitally driving each of said sharpening members, said housing having a pair of slots at said first honing section with each slot disposed opposite said outer faces of its sharpening member, first honing section guide means in said housing opposite respective outer faces of its sharpening member, said first honing section guide means having guide surfaces at mirror image angles to each other with said mirror image angles differing from said mirror image angles of said pre-sharpening section, said housing having a pair of slots at said second honing section with each slot disposed opposite said outer faces of its sharpening member, second honing section guide means in said housing opposite respective outer faces of its sharpening member, and said second honing section guide means having guide surfaces at mirror image angles to each other with said second honing section mirror image angles differing from said mirror image angles of said pre-sharpening section and of said first honing section.

10. The sharpener of claim 9 wherein said disks and said sharpening members are vertically mounted, said disks being slidably mounted on said shaft, and resilient means urging said disks away from each other.

11. The apparatus of claim 9 wherein at least one of said drive means imparting an orbital motion to each of said particles on its sharpening member of no greater than ⅜ inch effective diameter and an orbital velocity of no greater than 1500 feet/minute.

12. A method of sharpening a knife comprising placing the knife in a sharpener by guiding the knife against an orbitally driven sharpening member having abrasive particles on its exposed surface, orbitally driving the sharpening member to impart an orbital motion to each of the abrasive particles of no greater than ⅜ inch effective diamter an an orbital velocity of no reater than 1500 feet/minute, the sharpener having a pair of slots each with guide means at mirror image angles for directing the knife edge against opposite sides of the same sharpening member, including the step of placing the knife against one of the guide means and into its respective slot against the orbitally driven sharpening member, removing the knife from: the one slot, placing the knife against the other guide means into its respective slot against the orbitally driven sharpening member, orbitally driving the sharpening member to impart an orbital motion to each of its abrasive particles of no greater than ⅜ inch effective diameter and an orbital velocity of no greater than 1500 feet/minute when the knife is in each slot, including a second honing section in the sharpener with a pair of slots each having guide means at mirror image angles different from the mirror image angles of the first honing section for directing the knife edge against a second orbitally driven sharpening member having abrasive particles on its exposed surfaces, including the steps of removing the knife from the first honing section, placing the knife against one of the second honing section guide means with the knife against the second sharpening member, orbitally driving the second sharpening member to impart en orbital motion to each of its abrasive particles of no greater than ⅜ inch effective diameter and an orbital velocity of no greater than 1500 feet/minute, removing the knife rom the one slot of the second honing section, placing the knife against the other guide means of the second honing section with the knife edge against the second sharpening member, orbitally driving the second sharpening member to impart an orbital motion to each of its abrasive particles of no greater than ⅜ inch effective diameter and an orbital velocity of no greater than 1500 feet/minute, including a pre-sharpening section in the sharpener with a pair of slots each having guide means at mirror image angles different than the angles of the honing sections for directing the knife edge against a rotating disk associated with each pre-sharpening slot, including the steps prior to inserting the knife into the honing sections by placing the knife against one of the pre-sharpening guide means into its respective slot with the knife edge against the rotating disk at that slot, removing the knife from the one pre-sharpening slot, and placing the knife against the other pre-sharpening guide means into its respective slot with the knife edge against a rotating disk at that slot.

13. The method of claim 12 wherein a pair of rotating disks are slidably mounted to a shaft with resilient means urging the disks apart and with each disk being associated with a respective slot in the pre-sharpening section, and wherein the steps of placing the knife in the pr-sharpening section slots includes opposing the resilient force reacting against the respective disks.

* * * * *

UNITED STATES PATENT AND TRADEMARK OFFICE

CERTIFICATE OF CORRECTION

PATENT NO. : 4,807,399

DATED : February 28, 1989

INVENTOR(S) : Daniel D. Friel

It is certified that error appears in the above-identified patent and that said Letters Patent is hereby corrected as shown below:

Column 5, line 57 "an" should be --and--;

Column 5, line 61 "aces" should be --faces--;

Column 7, line 36 "diamter an" should be --diameter and--; and

Column 7, line 36 "reater" should be --greater--.

Signed and Sealed this

Twenty-fourth Day of October, 1989

*Attest:*

DONALD J. QUIGG

*Attesting Officer*

*Commissioner of Patents and Trademarks*